US008311252B2

(12) United States Patent
Dittli et al.

(10) Patent No.: US 8,311,252 B2
(45) Date of Patent: Nov. 13, 2012

(54) HEARING DEVICE

(75) Inventors: Erich Dittli, Reichenburg (CH); Daniel Mueller, Zuerich (CH); Christoph Leist, Rapperswil (CH)

(73) Assignee: Phonak AG, Staefa (CH)

( * ) Notice: Subject to any disclaimer, the term of this patent is extended or adjusted under 35 U.S.C. 154(b) by 485 days.

(21) Appl. No.: 12/444,413

(22) PCT Filed: Oct. 10, 2007

(86) PCT No.: PCT/EP2007/060765

§ 371 (c)(1),
(2), (4) Date: Apr. 6, 2009

(87) PCT Pub. No.: WO2008/015295

PCT Pub. Date: Feb. 7, 2008

(65) Prior Publication Data

US 2010/0111341 A1 May 6, 2010

(30) Foreign Application Priority Data

Oct. 11, 2006 (CH) ..... 1621/06

(51) Int. Cl.
*H04R 25/00* (2006.01)

(52) U.S. Cl. ..... 381/324; 381/322; 381/328; 381/330

(58) Field of Classification Search ..... 381/322, 381/324, 328, 330
See application file for complete search history.

(56) References Cited

U.S. PATENT DOCUMENTS

| | | | | |
|---|---|---|---|---|
| 4,588,867 | A | 5/1986 | Konomi | |
| 5,404,407 | A * | 4/1995 | Weiss | 381/314 |
| 7,016,512 | B1 * | 3/2006 | Feeley et al. | 381/324 |
| 7,110,562 | B1 * | 9/2006 | Feeley et al. | 381/322 |
| 7,139,404 | B2 * | 11/2006 | Feeley et al. | 381/330 |
| 7,215,789 | B2 * | 5/2007 | Shennib et al. | 381/328 |
| 2002/0181728 | A1 | 12/2002 | Connors et al. | |
| 2004/0010181 | A1 * | 1/2004 | Feeley et al. | 600/25 |
| 2007/0009130 | A1 * | 1/2007 | Feeley et al. | 381/330 |

FOREIGN PATENT DOCUMENTS

| | | | |
|---|---|---|---|
| EP | 1750480 | A | 2/2007 |
| WO | 2004025990 | A1 | 3/2004 |

OTHER PUBLICATIONS

International Search Report for PCT/EP2007/060765 dated Jan. 28, 2008.

* cited by examiner

*Primary Examiner* — Elvin G Enad
*Assistant Examiner* — Alexander Talpalatskiy
(74) *Attorney, Agent, or Firm* — Peare & Gordon LLP

(57) ABSTRACT

The present invention generally relates to a hearing device with a main housing (10) to be worn behind the ear, a secondary housing (20) separated thereof and to be arranged partly or completely within the ear and a speaker, and a connecting element (30) being arranged between the main housing (10). The secondary housing (20), includes at least an electrical and/or an acoustical connection between the speaker and the main housing (10). According to the present invention, at least one damping element (44) is arranged between the main housing (10) and the secondary housing (20). The damping element (44) reduces or prevents the transfer of vibrations between the microphone (15) and the speaker.

6 Claims, 3 Drawing Sheets

HEARING DEVICE

BACKGROUND OF THE INVENTION

1. Field of Invention

The present invention relates to a hearing device.

2. Description of Related Art

The term hearing device shall be understood as a device to be worn at the vicinity or directly within the ear of a person to improve the individual hearing capacity of this person. Such an improvement may include the prevention of the receiving of certain acoustic signals in terms of ear protection. In relation to the application of such hearing devices they can be worn behind the ear (BTE), within the ear (ITE) or completely within the ear (CIC).

Such hearing devices normally comprise of at least one microphone as acoustic receiving element, a speaker as acoustic output element and an electronic element connected with said microphone and said speaker for the processing and inducement of electronic signals. This electronic element may comprise analogue or digital signal processing devices.

The main housing of BTE hearing devices which are worn behind the ear may be connected to an ITE element, usually by a connection channel. This connecting channel may be rigid, flexible or elastic and may comprise besides electrical conduits acoustical conductive channels as well.

On such hearing devices, the microphone may be arranged within the main housing and the speaker within the ITE element. The connection may be realized for instance through a tube that is detachably connected with the main housing, as described for instance in WO 2004/025990, where the detachable connection is realized by an electrically conductive plug-in connection.

One problem of such hearing devices is the acoustical and mechanical feedback between microphone and speaker. This feedback has to be damped, reduced or interrupted for a stable hearing system. Commonly, the microphone and/or speaker will therefore be resiliently supported or mounted respectively and a maximized distance between microphone and speaker is intended. Such provisions are restricted due to the high level of miniaturization, the predetermined geometry and size of the individual auditory canal and the size of the microphone and especially of the speaker. Especially for designing the element as CIC element, e.g. to be arranged completely within the auditory canal, there is hardly any space for such a resilient suspension of the speaker.

Furthermore for such known arrangements, a mechanical coupling consists between the main housing and the element through the connection with a tube, thus always resulting in a mechanical feedback. Frequently, vibrations will be inducted and transferred to the microphone over the generally detachable connection between the tube and the main housing.

BREIF SUMMARY OF THE INVENTION

A problem to be solved by the present invention is finding a hearing device that prevents or reduces mechanical feedback over the connecting means between main housing and external speaker element.

This problem is inventively solved by a hearing device according to the present invention.

The hearing device with a main housing to be worn behind the ear, a secondary housing separated thereof and to be arranged partly or completely within the ear and comprising a speaker, and a connecting element being arranged between the main housing and the secondary housing, comprises at least an electrical and/or an acoustical connection between the speaker and the main housing. According to the present invention, at least one damping element is arranged between the main housing and the secondary housing. The damping element reduces or prevents the transfer of vibrations between the microphone and the speaker. By arranging the damping element between the main housing and the secondary housing, no space for damping material will be required especially in the secondary housing and therefore there is no drawback to the miniaturization of the hearing device. This allows the application of high-capacity speakers with its relative large natural dimensions by utilizing practically the whole available volume space of the secondary housing and although reliably reducing or avoiding any mechanical feedback.

For instance the connecting element is provided as a tube, having on one end a connector part that is mechanically connectable with a socket arranged at the main housing. Therefore, a simple but mechanical stable connection will be provided. The connector part and socket may be configured as an electrical connection, to connect the speaker with an electronic module of the hearing device. Furthermore, at least one acoustically conductive connection persistent between the main housing and the secondary housing may be realized, i.e. in form of a tunnel or a pipe within the tube. Such a connection may for instance be used as vent between the secondary housing and the main housing.

The damping element is for instance provided as a head part of the main housing and detachably and form-locking connected to the latter, whereby the connector part is form-locking insertable into an opening of the head part. Thus, the whole head part of the main housing serves as damping part, which is highly efficient due to its relative big size and therefore provides good damping characteristics. The connection between connector part and socket may be reduced solely to an electrical connection as the connector part is form-locking connected to the head part, whereby practical any mechanical feedback is avoided at that location.

For instance, head part and connector part are fixed to each other by a pin arranged crosswise in relation to the insertion direction of the connector part. The detachable connection is thereby fixed in an easy and reliable manner. The connection is prevented from self-loosening for instance by having the pin counterbored and friction fitted within its opening of the head part.

The head part is for instance fixed by a resilient snap-in pin to the main housing. Thereby, an easy connection is realized that is optically invisible from the outside, if the snap-in pin is arranged at the inner side of the housing of the head part. Furthermore, the head part may be designed free with respect of its size and shape and thereby may accomplish different optical requirements.

In a further embodiment, the damping element is arranged as a cap or bush between the surfaces facing each other of connector and socket. This provides a mechanical separation of the direct connection between connector and socket, whereby any possible vibrations will not be transmitted from the connector to the socket but will be absorbed by the damping element. Nevertheless, a possible electrical connection between connector and socket remains maintained.

In a further embodiment, the damping element is arranged between the connector part and a head part of the main housing in the area of the socket. Thus, a direct contact between the connector part and the head part of the main housing is avoided and no mechanical feedback channel will thus be established.

In another embodiment, the damping element is provided as a hollow cylinder, preferably as a mushroom-shaped element with a collar abutting against the outside of the head part. Such a part may easily be inserted into the respective opening for the connector or the tube respectively. The opening will furthermore be sealed due to the mushroom-shaped design with the collar and thus no dirt or moisture may intrude into the inside of the head part to damage for instance the electrical connection between connector and socket.

In a further embodiment, the damping element is arranged between one end of the tube and the connector part. The mechanical feedback path will thus be interrupted between the tube and the connector part.

For instance, the damping element is provided as a cylindrical bush. Such a bush is easily moved onto the tube and positioned at the region of the connector part.

In another embodiment, the connecting element is provided as damping element in form of a tube and having a connector part on its one end that is mechanically connectable with a socket arranged at the main housing. That means that the connector element as a whole is laid-out to be a damping element, thus inhibiting the generation, transmission and amplification of possible vibrations. A high efficient mechanical damper will be achieved due to the huge mass or volume respectively compared to other damping elements.

In a further embodiment, the damping element is designed as vibration damper and is composed of a soft plastic. The construction and configuration of the damping element is designed such as to receive vibrations and thereby interrupts a possible mechanical feedback path.

For instance, the material for the damping element is at least one of the following plastics:

polyamide 6.6
polyamide 12
polypropylene
polyurethane
pebax
TPE
silicone.

It has been shown that these materials provide particular efficient damping values and provide a high efficient mechanical damping behavior.

In another embodiment, the damping element has a damping coefficient of at least 0.1, preferably of at least 0.2, or preferably of at least 0.25 or higher. The damping coefficient may be calculated or determined respectively by use of finite element analysis (FEA). A specific FEA model will be generated for the hearing device concerned and the material properties will be collected to determine the damping coefficient for the specific FEA model. The following data have been obtained for an example of an inventive hearing device with a connector tube serving as damping element:

| material | damping coefficient |
|---|---|
| Polyamide 12 | 0.25 |
| Polypropylene | 0.20 |
| Polyurethan | 0.17 |
| Pebax | 0.25 |

These determined data are suitable to be used in a specific FEA model named "ALGOR".

Instead of using a hearing device to determine the damping coefficient, other geometries, such as experimental geometries, may be used as well.

BRIEF DESCRIPTION OF THE DRAWINGS

For purpose of facilitating and understanding of the invention, there is illustrated in the accompanying drawings preferred embodiments thereof to be considered in connection with the following description.

DETAILED DESCRIPTION OF THE INVENTION

Figure 1:
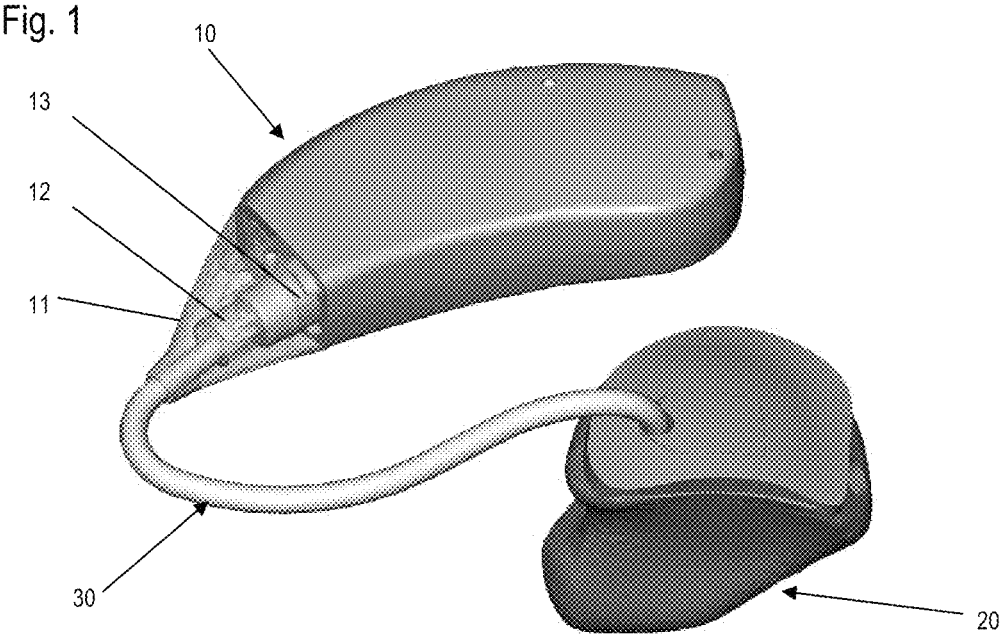
FIG. 1 is a view of a common ITE hearing device with main housing and secondary housing.

FIG. 1 depicts a common BTE hearing device with a main housing 10 and an ITE element as secondary housing 20, which are connected to each other via a tube 30 as connecting element.

The head part 11 is arranged as a pyramidal shaped hollow body on one end of main housing 10, with the tube 30 being inserted through the cone end towards the inner side of head part 11. The end of tube 30 is provided by a connector part 12 receiving the electrical contacts of the conductor cables arranged within tube 30 that are electrically connected to a socket 13 arranged at the main housing 10. The connector part 12 is thereby form-locking and force-locking connected to socket 13 and absorbs as well the mechanical forces impacting onto tube 30 and transmits them to the main housing 10. Vibrations will thereby transmitted as well directly from the main housing 10 onto the tube 30 and vice-versa, thus providing a mechanical feedback path between the speaker (not shown in FIG. 1) arranged in the secondary housing and the microphone 15 arranged in the main housing 10.

Figure 2:
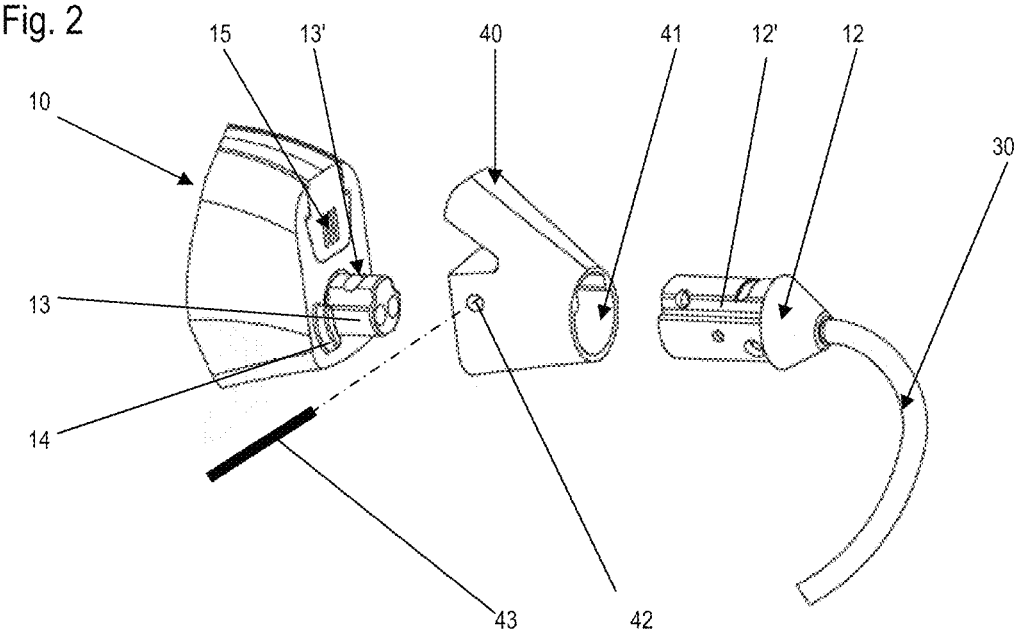
FIG. 2 is a view of the inventively designed connection part of the connection means between main housing and secondary housing.

By arranging a damping element 40 according to the present invention in form of a common head part of the main housing 10, as depicted in FIG. 2, the mechanical feedback path will be interrupted. The connector part 12 is provided with nuts or grooves 12' at its outer surface that matches form-locking to the insertion opening 41 of the damping element 40. Thus, a form-locking and force-locking connection between the connector part 12 and the damping element 40 will be achieved. The transmission of vibrations from tube 30 to the main housing 10 and vice-versa will thus be reliably avoided and thereby the generation of a mechanical feedback path between microphone and speaker avoided. Furthermore, a positioning help for the connector part 12 is realized by accordingly arranging nuts or grooves 12' respectively which prevents a wrong mounting of connector part 12.

A bore or opening 42 respectively is arranged at the damping element 40 crosswise in relation to the insertion direction of connector part 12, for the insertion of a pin 43 for locking the connector part 12 within the damping element 40. A friction-fit is provided between the bore or opening 42 and the pin 43 for preventing the pin 43 of being independently shifted and to provide a reliable fixing of the connector part 12 within the damping element 40.

This pin 43 may be used as well for locking the damping element 40 at the main housing 10, for instance by providing a nut 13' on the socket 13.

The damping element 40 may be attached onto the main housing 10 for instance by one or several resilient snap-in pins 14 arranged sideways of head part 40.

Figure 3:
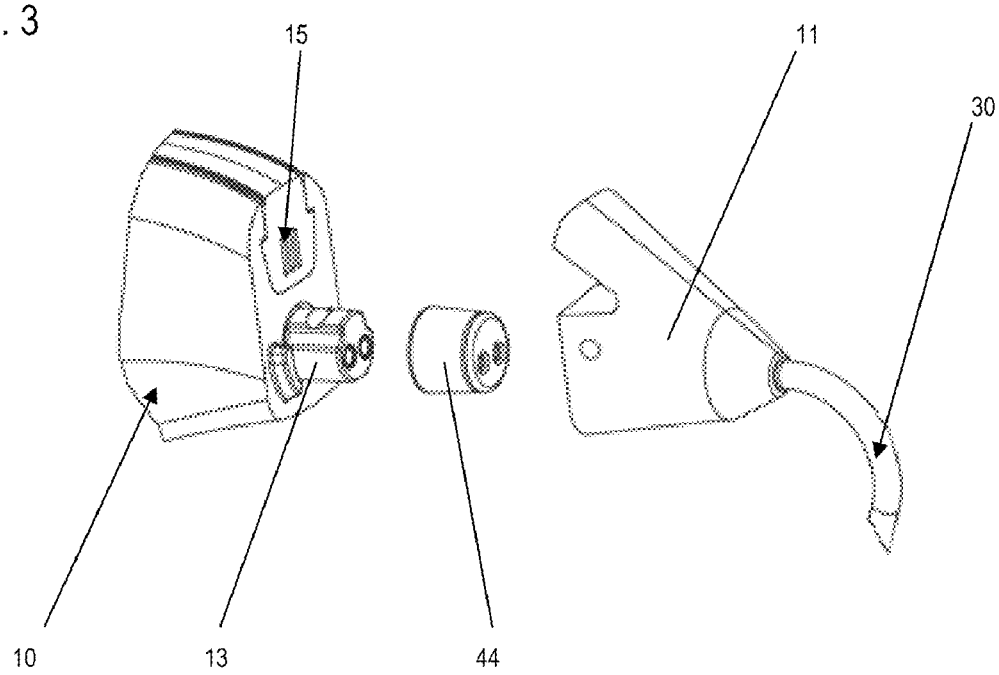
FIG. 3 is the view according to FIG. 2 in an alternative embodiment.

FIG. 3 depicts another embodiment of the present invention wherein the damping element is provided as a cap or bush 44 to be slid onto socket 13. A damping layer will therefore be provided between the surfaces facing each other of connector pin 12 and socket 13 preventing the formation of a feedback path at this place. The head part 11 may be shaped in common manner or may serve additionally to the cap or bush 44 as a damping element analogue to the damping element 40 according to FIG. 2 for supporting the damping action.

Figure 4:
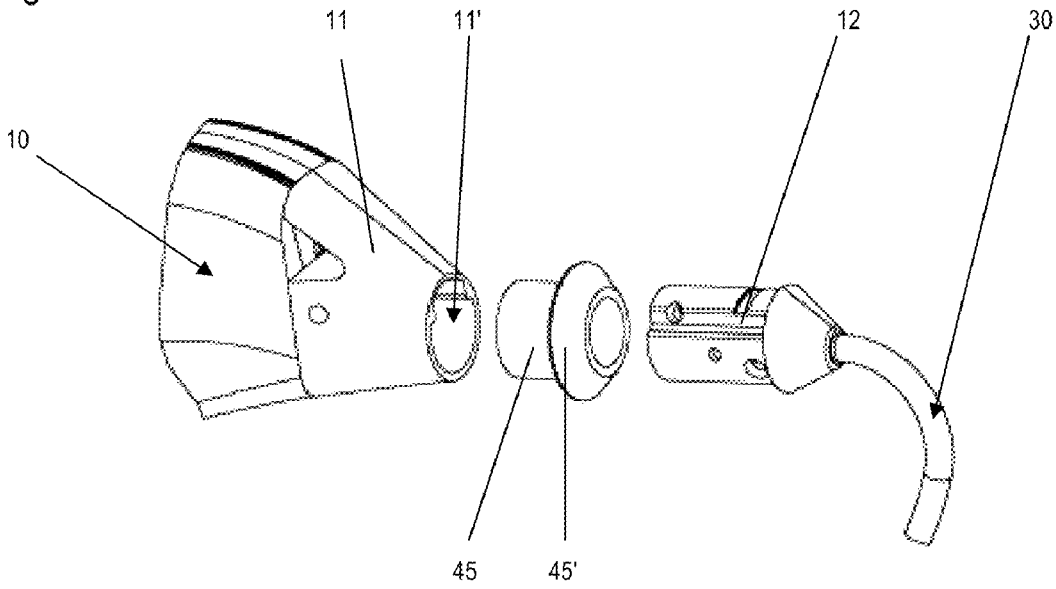
FIG. 4 is the view according to FIG. 2 in a further alternative embodiment.

FIG. 4 depicts a further embodiment of the present invention with the damping element designed as mushroom-shaped hollow cylinder 45. The hollow cylinder 45 is inserted into the opening 11' of head part 11 and serves as a damping layer between the outside of connector part 12 and the inside of the head part 11. Therefore, no mechanical feedback path may be established at this location. A collar 45' is provided at the outside of the end of hollow cylinder 45 for preventing or at least reducing the penetration of dirt and moisture through the opening 11' into the inside of head part 11.

In this configuration, the head part 11 may as well consist of a common layout or be an inventive damping element.

Figure 5:
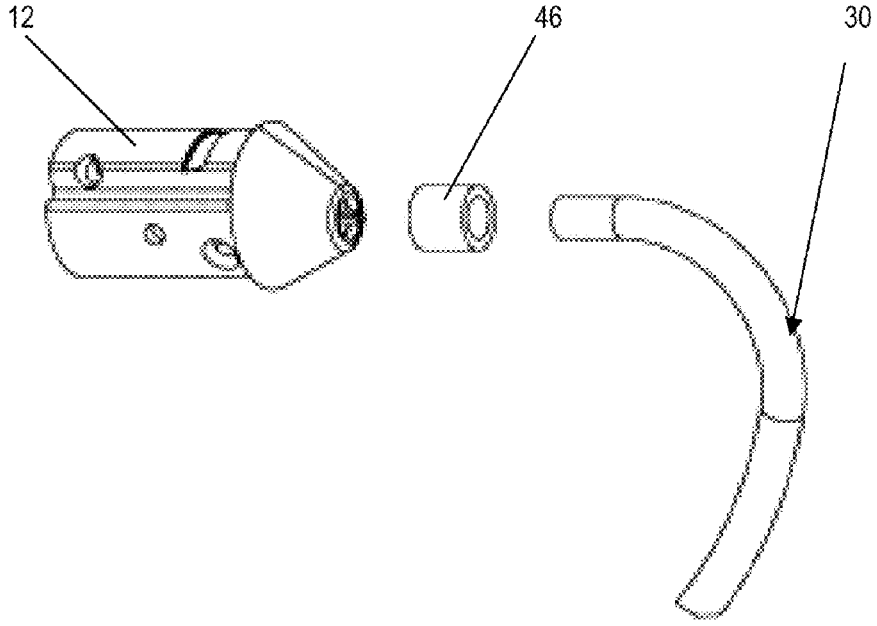
FIG. 5 is the view according to FIG. 2 in a further alternative embodiment.

In FIG. 5 is again depicted another embodiment of the present invention. A damping element in form of a cylindrical bush 46 is arranged at the end of tube 30 on its outside or outer wall respectively. This bush 46 receives vibrations and thereby interrupts a possible mechanical feedback path between tube 30 and connector part 12.

This damping element 46 may be used alone or in combination with the antecedent described damping elements 40, 44, 45.

What is claimed is:

1. Hearing device comprising:

a main housing (10) to be worn behind the ear, a secondary housing (20) separated thereof and to be arranged partly or completely within the ear and comprising a speaker, a connecting element (30) being arranged between the main housing (10) and the secondary housing (20), comprising at least an electrical and acoustical connection between the speaker and the main housing (10), the connecting element is provided as a tube (30), having on one end a connector part (12) that is mechanically connectable with a socket (13) arranged at the main housing (10), and at least one damping element (30;40;44;45;46) arranged between the main housing (10) and the secondary housing (20), wherein the damping element is provided as a head part (40) of the main housing (10) and detachably and form-locking connected to the latter, whereby the connector part (12) is form-locking insertable into an opening (41) of the head part (40), and wherein the head part (40) and the connector part (12) are fixed to each other by a pin (43) arranged crosswise in relation to the insertion direction of the connector part (12).

2. Hearing device comprising:

a main housing (10) to be worn behind an ear, a secondary housing (20) separated thereof and to be arranged partly or completely within the ear and comprising a speaker, a connecting element (30) being arranged between the main housing (10) and the secondary housing (20), comprising at least an electrical or an acoustical connection between the speaker and the main housing (10), the connecting element is provided as a tube (30), having on one end a connector part (12) that is mechanically connectable with a socket (13) arranged at the main housing (10), and at least one damping element (30;40;44;45;46) arranged between the main housing (10) and the secondary housing (20), wherein the damping element is provided as a head part (40) of the main housing (10) and detachably and form-locking connected to the latter, whereby the connector part (12) is form-locking insertable into an opening (41) of the head part (40), and wherein the head part (40) is fixed by a resilient snap-in pin (14) to the main housing (10).

3. Hearing device comprising:

a main housing (10) to be worn behind an ear, a secondary housing (20) separated thereof and to be arranged partly or completely within the ear and comprising a speaker, a connecting element (30) being arranged between the main housing (10) and the secondary housing (20), comprising at least an electrical or an acoustical connection between the speaker and the main housing (10), the connecting element is provided as a tube (30), having on one end a connector part (12) that is mechanically connectable with a socket (13) arranged at the main housing (10), and at least one damping element (30;40;44;45;46) arranged between the main housing (10) and the secondary housing (20), wherein the damping element is arranged as a cap or bush (44) between the surfaces facing each other of connector (12) and socket (13).

4. Hearing device comprising:

a main housing (10) to be worn behind an ear, a secondary housing (20) separated thereof and to be arranged partly or completely within the ear and comprising a speaker, a connecting element (30) being arranged between the main housing (10) and the secondary housing (20), comprising at least an electrical or an acoustical connection between the speaker and the main housing (10), the connecting element is provided as a tube (30), having on one end a connector part (12) that is mechanically connectable with a socket (13) arranged at the main housing (10), and at least one damping element (30;40;44;45;46) arranged between the main housing (10) and the secondary housing (20), wherein the damping element is arranged between the connector part (12) and a head part (11) of the main housing (10) in an area of the socket (13), and wherein the damping element is provided as a hollow cylinder (45) with a collar abutting against the outside of the head part (11).

5. Hearing device comprising:

a main housing (10) to be worn behind an ear, a secondary housing (20) separated thereof and to be arranged partly or completely within the ear and comprising a speaker, a connecting element (30) being arranged between the main housing (10) and the secondary housing (20), comprising at least an electrical or an acoustical connection between the speaker and the main housing (10), the connecting element is provided as a tube (30), having on one end a connector part (12) that is mechanically connectable with a socket (13) arranged at the main housing (10), and at least one damping element (30;40;44;45;46) arranged between the main housing (10) and the secondary housing (20), wherein the damping element is arranged between one end of the tube (30) and the connector part (12).

6. Hearing device according to claim 5, wherein the damping element is provided as a cylindrical bush (46).

* * * * *

UNITED STATES PATENT AND TRADEMARK OFFICE

CERTIFICATE OF CORRECTION

PATENT NO. : 8,311,252 B2
APPLICATION NO. : 12/444413
DATED : November 13, 2012
INVENTOR(S) : Erich Dittli et al.

It is certified that error appears in the above-identified patent and that said Letters Patent is hereby corrected as shown below:

On the title page item (74), should read as follows:

Attorney, Agent or Firm ---- Pearne & Gordon LLP

Signed and Sealed this
Sixth Day of May, 2014

Michelle K. Lee

Michelle K. Lee
*Deputy Director of the United States Patent and Trademark Office*